US011742160B1

(12) United States Patent
Chen et al.

(10) Patent No.: US 11,742,160 B1
(45) Date of Patent: Aug. 29, 2023

(54) KEY STRUCTURE

(71) Applicant: Acer Incorporated, New Taipei (TW)

(72) Inventors: Hung-Chi Chen, New Taipei (TW); Cheng-Han Lin, New Taipei (TW)

(73) Assignee: Acer Incorporated, New Taipei (TW)

( * ) Notice: Subject to any disclaimer, the term of this patent is extended or adjusted under 35 U.S.C. 154(b) by 0 days.

(21) Appl. No.: 17/829,388

(22) Filed: Jun. 1, 2022

(30) Foreign Application Priority Data

Apr. 21, 2022 (TW) ..... 111115202

(51) Int. Cl.
*H01H 13/14* (2006.01)

(52) U.S. Cl.
CPC ..... *H01H 13/14* (2013.01); *H01H 2215/03* (2013.01); *H01H 2235/01* (2013.01)

(58) Field of Classification Search
CPC ..... H01H 13/00; H01H 13/02; H01H 13/04; H01H 13/10; H01H 13/14; H01H 13/50; H01H 13/70; H01H 2003/12; H01H 2013/00; H01H 2013/02; H01H 2013/50; H01H 2013/52; H01H 2215/03; H01H 2235/01; H01H 3/00; H01H 3/02; H01H 3/12; H01H 3/32; H01H 9/00; H01H 9/20; H01H 9/24
USPC ..... 200/341
See application file for complete search history.

(56) References Cited

U.S. PATENT DOCUMENTS

2017/0278649 A1* 9/2017 Liu ..... H01H 13/14
2018/0090286 A1* 3/2018 Chen ..... H01H 13/10

* cited by examiner

*Primary Examiner* — Anthony R Jimenez
(74) *Attorney, Agent, or Firm* — JCIPRNET

(57) ABSTRACT

A key structure including a base plate, a keycap disposed above the base plate, a scissor structure disposed between the base plate and the keycap, a first sleeve connected to the keycap, a second sleeve rotatably inserted into the first sleeve and a trigger member is provided. The first sleeve is located between the base plate and the keycap and has a guiding chute. The first sleeve is slidably sleeved on the second sleeve. The second sleeve has a guiding protrusion slidably disposed in the guiding chute and a notch opposite to the guiding protrusion, and the notch faces the base plate. The second sleeve is slidably sleeved on the trigger member. The trigger member has a trigger protrusion contacting the base plate, and the trigger protrusion is located between the base plate and the second sleeve.

10 Claims, 9 Drawing Sheets

KEY STRUCTURE

CROSS-REFERENCE TO RELATED APPLICATION

This application claims the priority benefit of Taiwan application serial no. 111115202, filed on Apr. 21, 2022. The entirety of the above-mentioned patent application is hereby incorporated by reference herein and made a part of this specification.

BACKGROUND

Technical Field

The invention relates to a key structure, and particularly relates to a key structure applied to a keyboard.

Description of Related Art

Keyboards as a common physical operation interface have been broadly applied to desktop computers, laptop computers, or other electronic devices. Based on the differences in structural designs, operational strokes, and trigger mechanisms, etc., keyboards may be generally classified into membrane keyboards and mechanical keyboards. Among membrane keyboards, scissor-switch keyboards are the most common type. In general, an elastic piece is provided inside a shaft of a key. When the user presses the key, the elastic piece is squeezed to create an elastic deformation and generate a sound, thereby making favorable user experience. However, limited by the operational stroke of the shaft of the key, the overall thickness of a mechanical keyboard is far greater than the overall thickness of a scissor-switch keyboard. Therefore, such mechanical keyboard is unable to meet the design requirement of being thin and compact. In addition, after being repetitively squeezed for a long time, the elastic piece may be deformed or deviated and may even be unable to generate a sound or affect the lifting stroke of the key.

SUMMARY

The invention provides a key structure which not only meets the design requirement of being thin and compact, but also facilitates user experience.

An aspect of the invention provides a key structure including a base plate, a keycap, a scissor structure, a first sleeve, a second sleeve, and a trigger member. The keycap is disposed above the base plate. The scissor structure is disposed between the base plate and the keycap. The first sleeve is connected to the keycap and located between the base plate and the keycap and has a guiding chute. The second sleeve is rotatably inserted into the first sleeve, and the first sleeve is slidably sleeved to the second sleeve. The second sleeve has a guiding protrusion and a notch opposite to the guiding protrusion. The guiding protrusion is slidably disposed in the guiding chute, and the notch faces the base plate. The second sleeve is slidably sleeved on the trigger member. The trigger member has a trigger protrusion contacting the base plate, and the trigger protrusion is located between the base plate and the second sleeve. The second sleeve abuts against the trigger protrusion during a process in which the first sleeve and the second sleeve move toward the base plate. The first sleeve keeps moving toward the base plate to drive the second sleeve to rotate relative to the first sleeve. When the notch rotates to be aligned to the trigger protrusion, the trigger protrusion moves into the notch and the second sleeve contacts the base plate.

Based on the above, in the key structure according to the embodiments of the invention, the retractable assembly is disposed between the keycap and the base plate, and a sound structure is integrated in the retractable assembly. When the keycap receives a force and is pressed down to move toward the base plate, the retractable assembly is compressed and knocks to make a sound. By doing so, the operation experience of the user (e.g., audio sensation) is facilitated. In addition, compared with a key structure adopting a mechanical shaft, the key structure of the invention adopts the scissor structure. Therefore, the key structure of the invention satisfies the design requirement of being thin and compact.

To make the aforementioned more comprehensible, several embodiments accompanied with drawings are described in detail as follows.

BRIEF DESCRIPTION OF THE DRAWINGS

The accompanying drawings are included to provide a further understanding of the disclosure, and are incorporated in and constitute a part of this specification. The drawings illustrate exemplary embodiments of the disclosure and, together with the description, serve to explain the principles of the disclosure.

DESCRIPTION OF THE EMBODIMENTS

Figure 1:
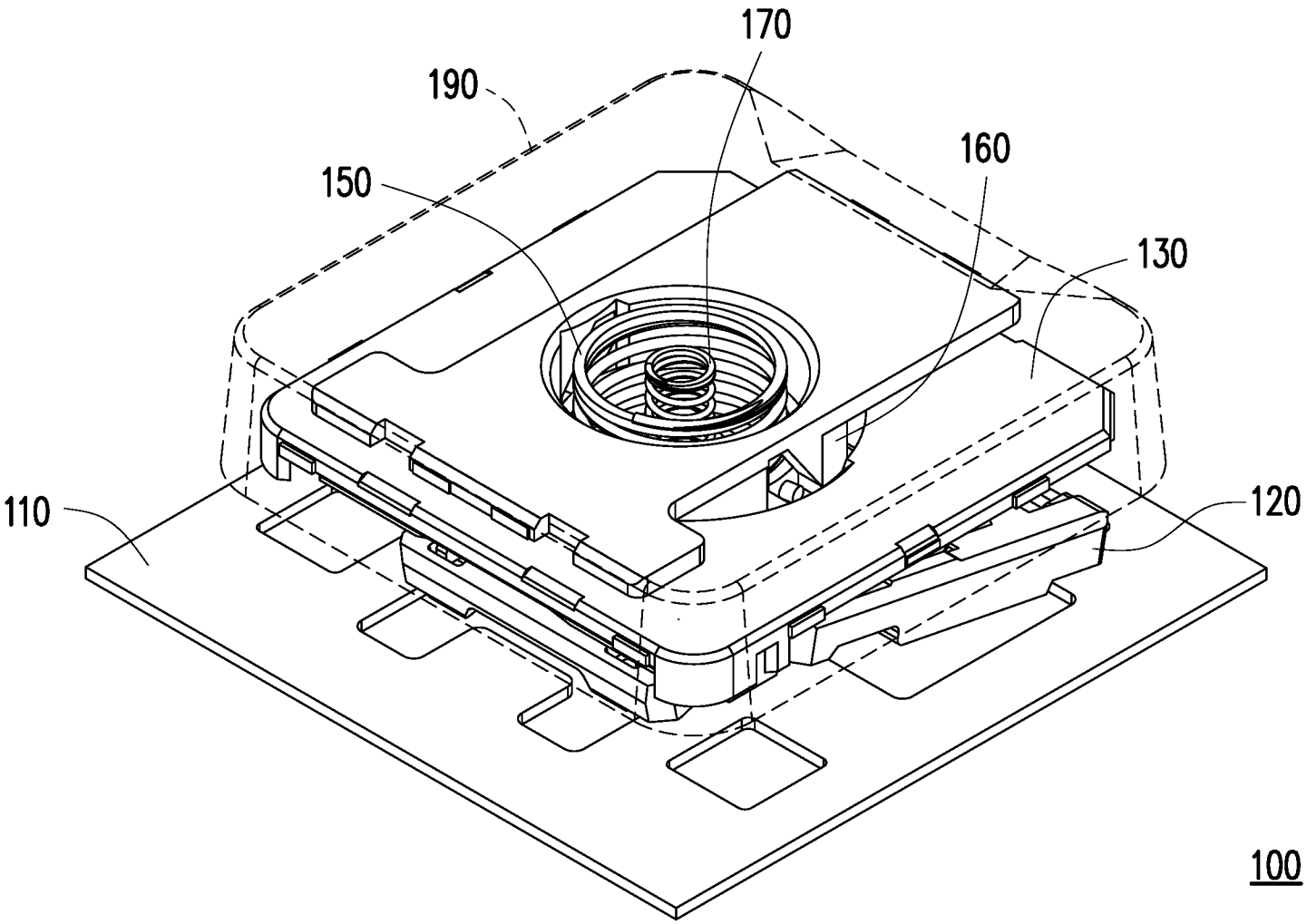
FIG. 1 is a schematic view illustrating a key structure according to an embodiment of the invention.
Figure 2A:
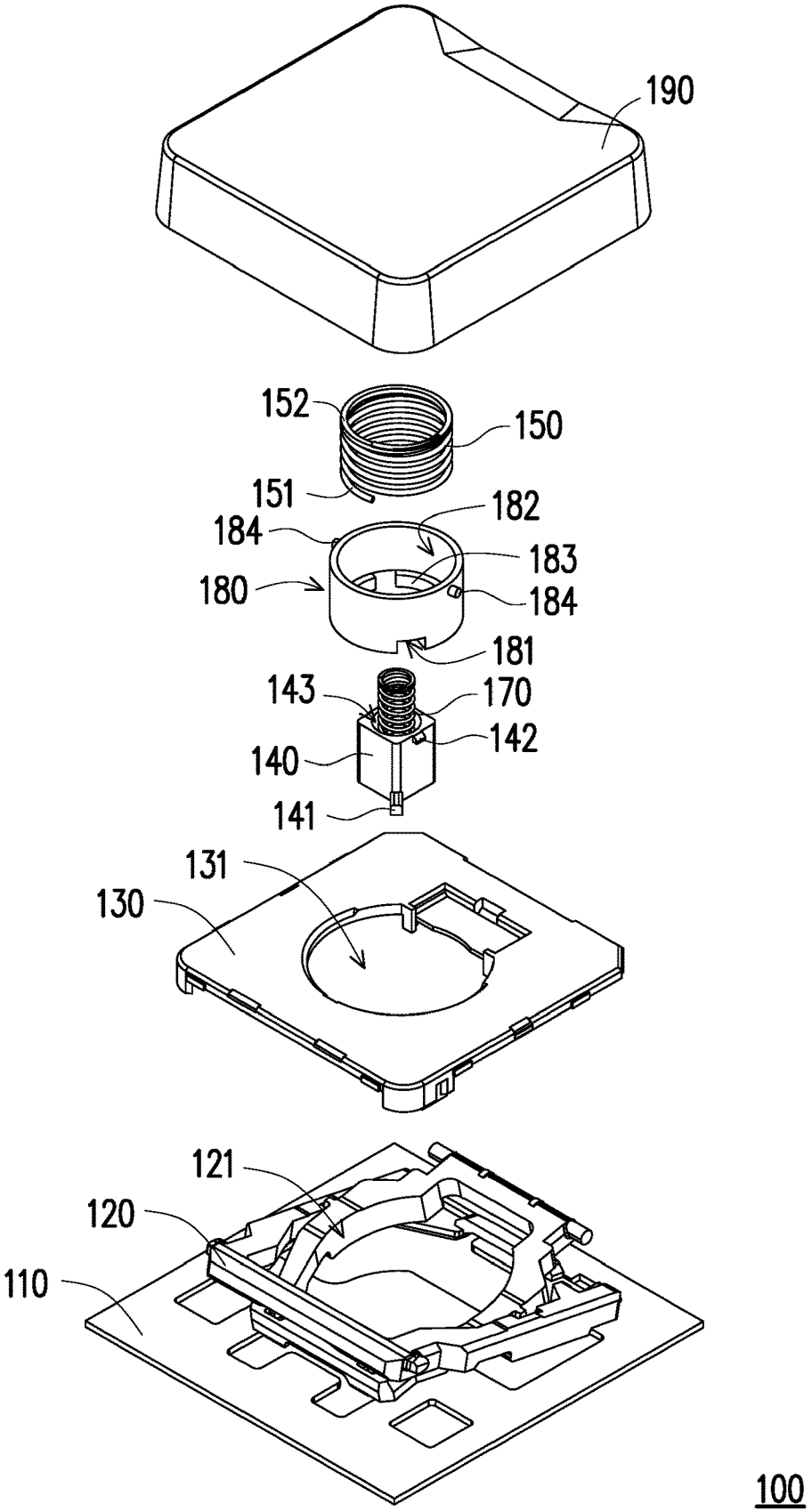
FIGS. 2A and 2B are schematic exploded views respectively illustrating the key structure of FIG. 1 from two different perspectives.
Figure 2B:
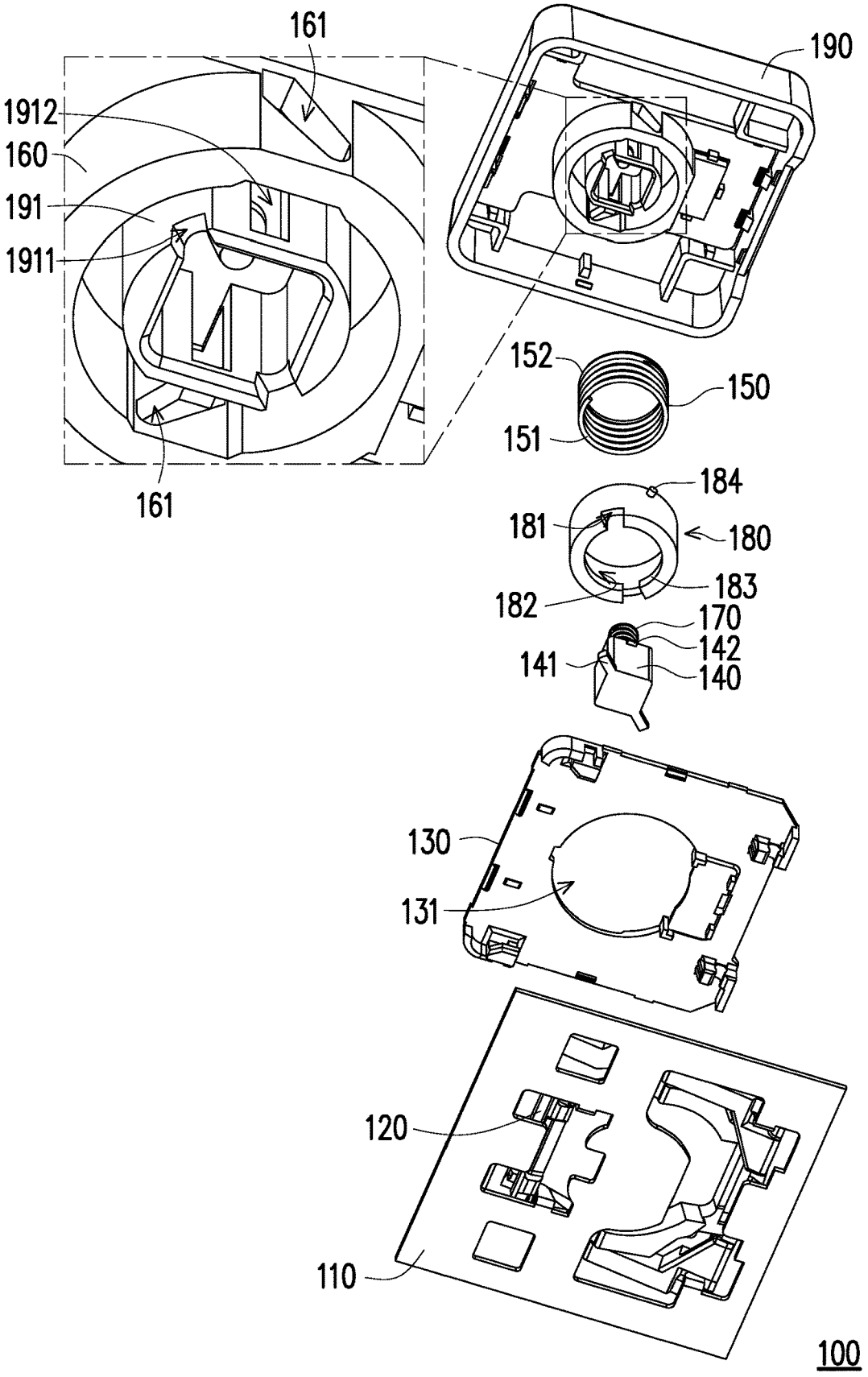

FIG. 1 is a schematic view illustrating a key structure according to an embodiment of the invention. FIGS. 2A and 2B are schematic exploded views respectively illustrating the key structure of FIG. 1 from two different perspectives. To clearly illustrate the configuration of the internal structure, a keycap 190 in FIG. 1 is shown in broken lines. Referring to FIGS. 1, 2A, and 2B, in the embodiment, a key structure 100 is applicable to a keyboard, and includes a base plate 110, a scissor structure 120, the keycap 190 and a retractable assembly. The scissor structure 120 and the retractable assembly are disposed between the base plate 110 and the keycap 190 and configured to support the keycap 190.

Figure 3A:
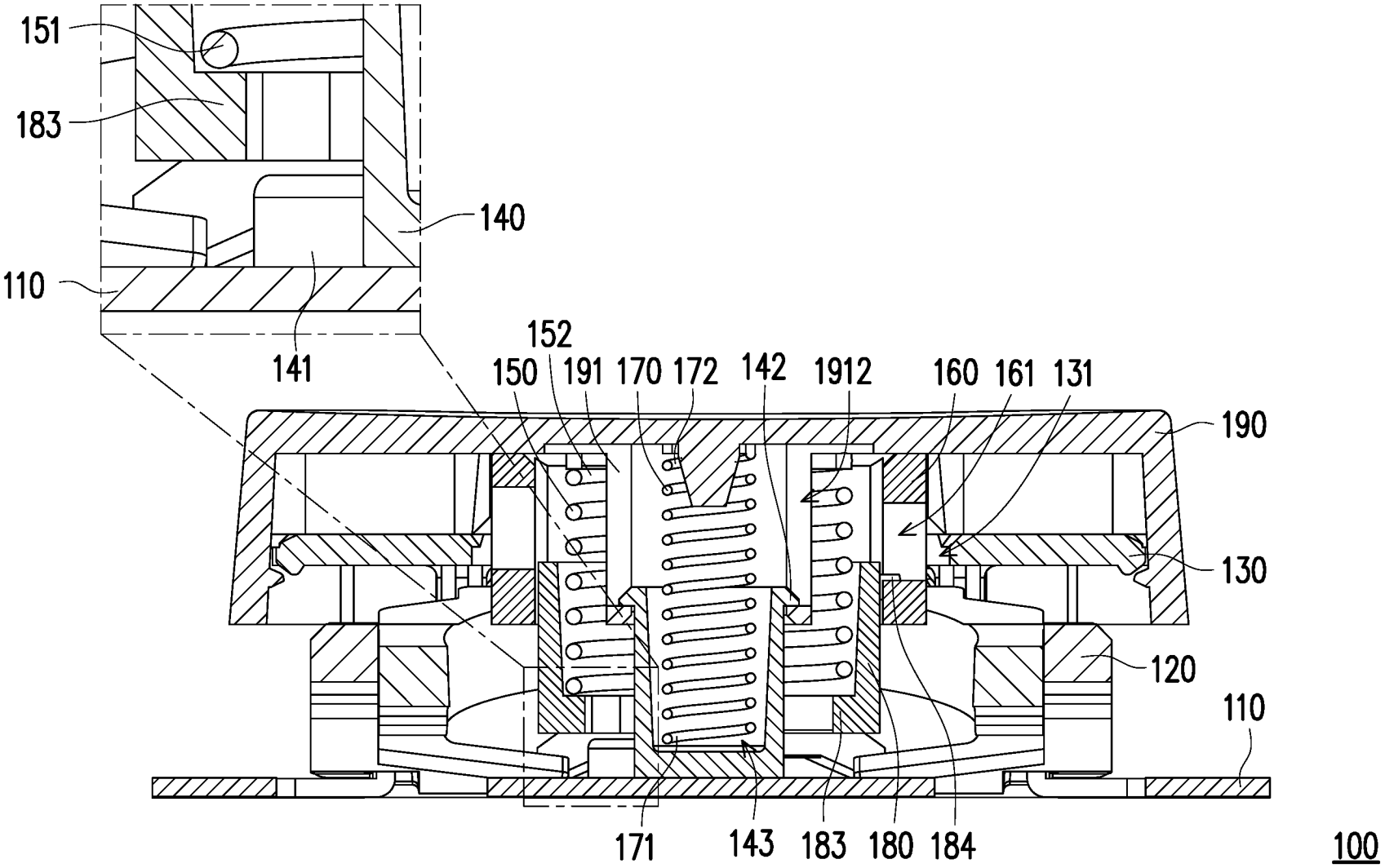
FIG. 3A is a schematic cross-sectional view illustrating the key structure of FIG. 1.
Figure 3B:
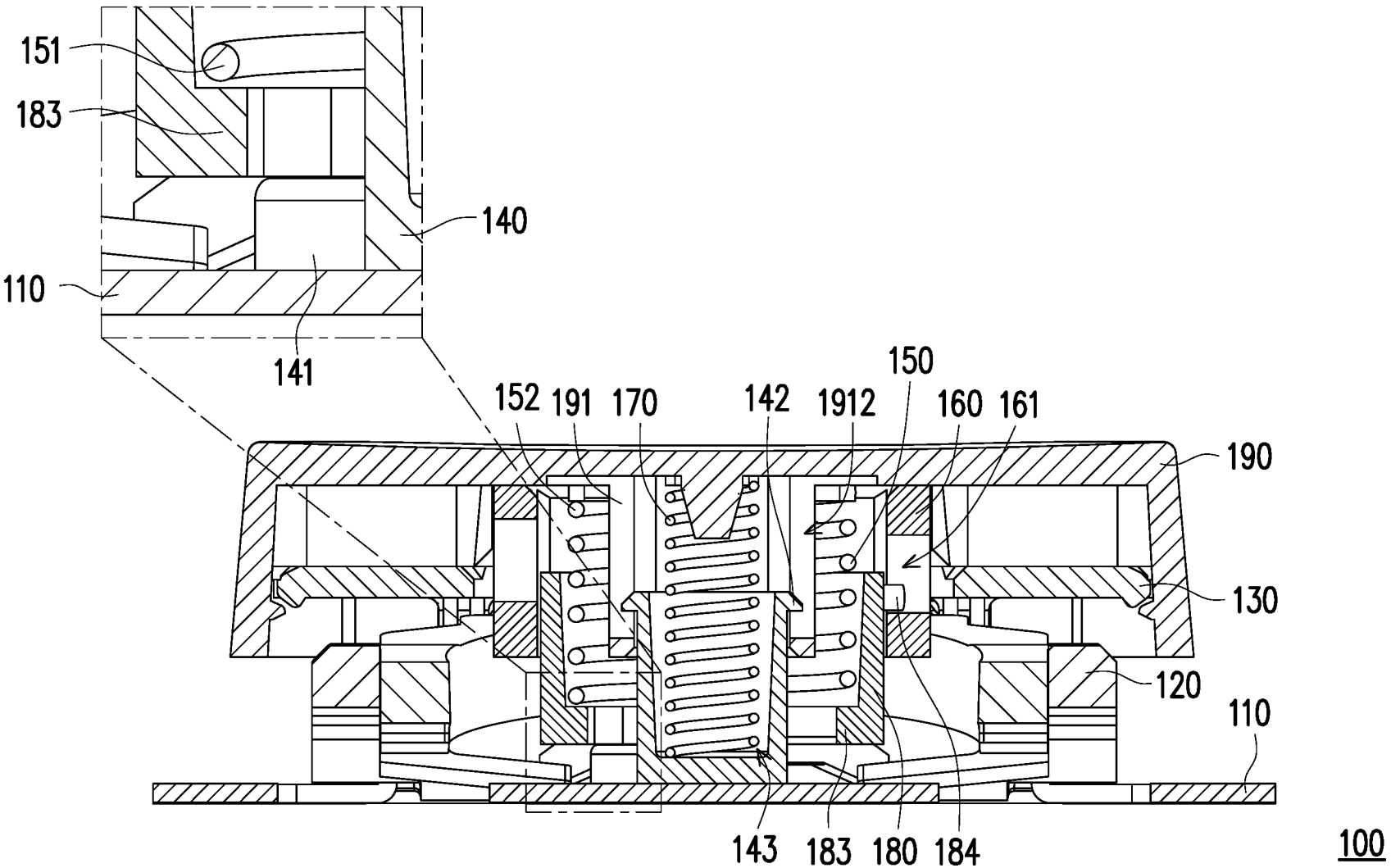
FIGS. 3B and 3C are schematic cross-sectional views illustrating the key structure of FIG. 3A when receiving a force and being pressed.
Figure 3C:
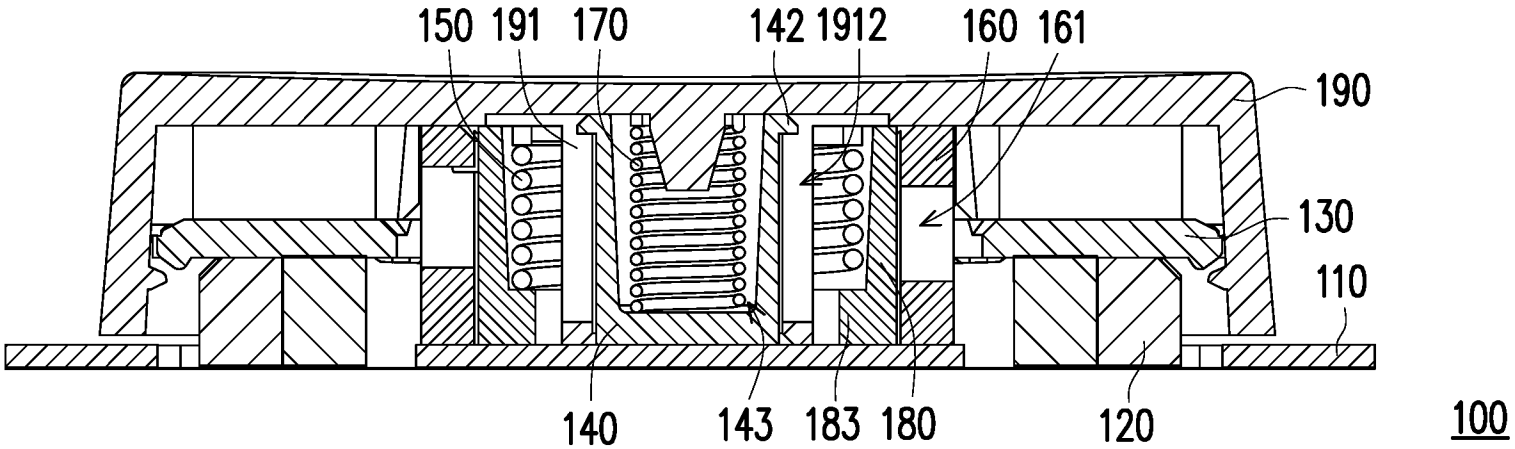

FIG. 3A is a schematic cross-sectional view illustrating the key structure of FIG. 1. FIGS. 3B and 3C are schematic cross-sectional views illustrating the key structure of FIG. 3A when receiving a force and being pressed. Referring to FIGS. 2A, 2B, and 3A, the retractable assembly at least includes a first sleeve 160, a second sleeve 180, and a trigger member 140. The first sleeve 160 is connected to the keycap 190, and the second sleeve 180 is inserted into the first sleeve 160. More specifically, the second sleeve 180 is rotatably inserted into the first sleeve 160, and the first sleeve 160 is slidably sleeved to the second sleeve 180. That is, the second sleeve 180 has a movement degree of freedom of sliding and rotating with respect to the first sleeve 160

The trigger member 140 is inserted into the second sleeve 180. In other words, the second sleeve 180 is slidably sleeved to the trigger member 140, and the bottom of the trigger member 140 is in contact with the base plate 110. In the initial state shown in FIG. 3A, the first sleeve 160 is separated from the base plate 110, and the second sleeve 180 is supported by the first sleeve 160 to be separated from the base plate 110.

Referring to FIGS. 2A, 2B, and 3A, in the embodiment, the first sleeve 160 has a guide chute 161, and the second sleeve 180 has a guiding protrusion 184 slidably disposed in the guiding chute 161. With the matching between the guiding protrusion 184 and the guiding chute 161, the first sleeve 160 and the second sleeve 180 can stay mechanically coupled with each other. Besides, when the first sleeve 160 and the second sleeve 180 slide relatively, the guiding protrusion 184 slides in the guiding chute 161 and drives the second sleeve 180 to rotate relative to the first sleeve 160.

Specifically, the trigger member 140 has a trigger protrusion 141 in contact with the base plate 110, and the trigger protrusion 141 is located between the base plate 110 and the second sleeve 180. The trigger protrusion 141 protrudes and extends outward from the outer wall surface of the trigger member 140, and is located at the bottom of the trigger member 140. In the initial state shown in FIG. 3A, the second sleeve 180 is supported by the first sleeve 160 to be separated from the trigger protrusion 141. As shown in FIG. 3B, when the keycap 190 receives a force and is pressed down to move toward the base plate 110, the first sleeve 160 and the second sleeve 180 synchronously move toward the base plate 110, and the second sleeve 180 abuts against the trigger protrusion 141. At this time, the trigger member 140 makes a first knock with respect to the second sleeve 180 to generate a first operation sound. Then, the first sleeve 160 keeps moving toward the base plate 110, and the second sleeve 180 slides relatively to the first sleeve 160. Then, the entirety of the second sleeve 180 moves into the first sleeve 160, and the first sleeve 160 and the second sleeve 180 simultaneously contact the base plate 110, as shown in FIG. 3C.

Figure 4A:
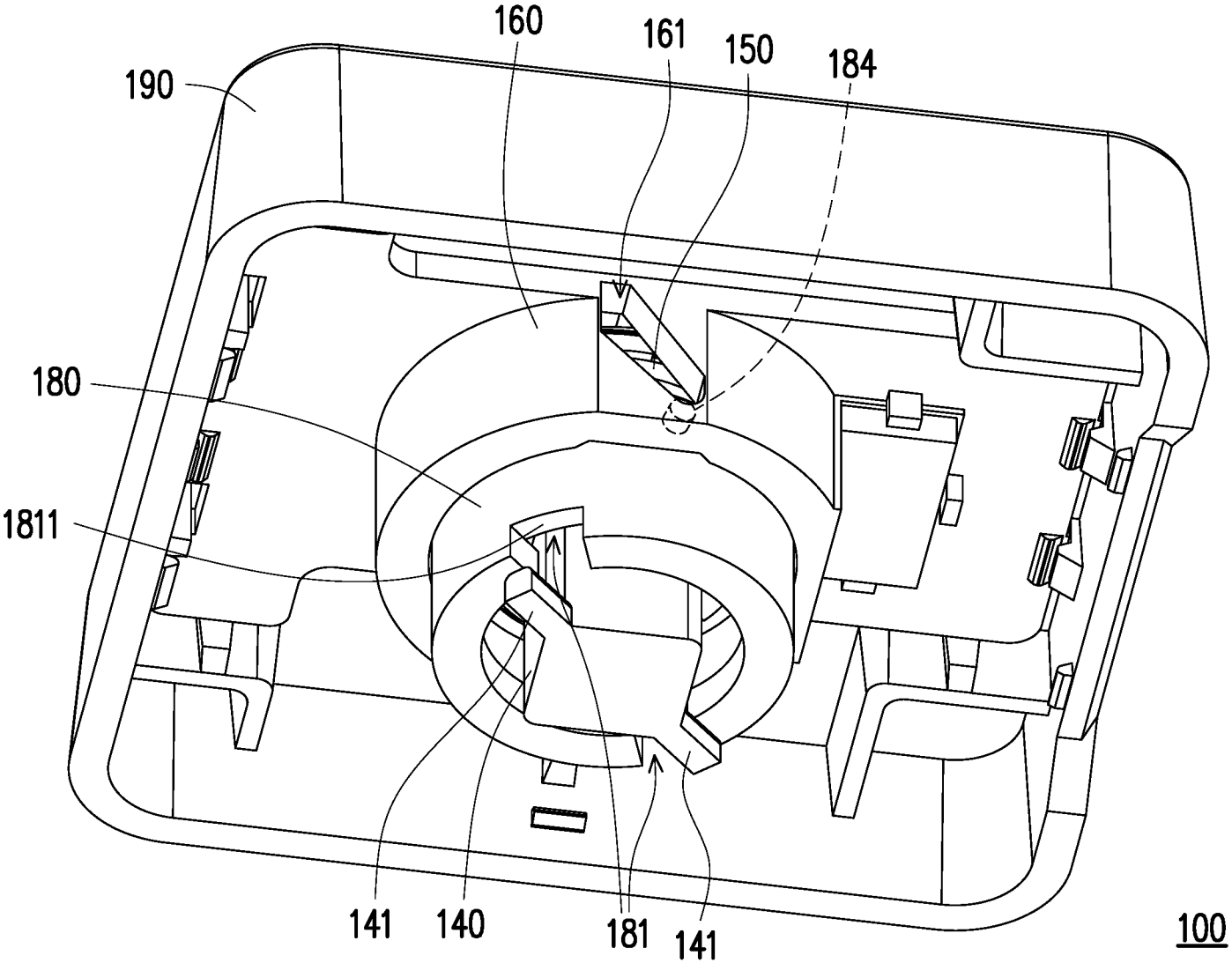
FIG. 4A is a schematic view illustrating a keycap and a retractable assembly of FIG. 1 from another perspective.
Figure 4B:
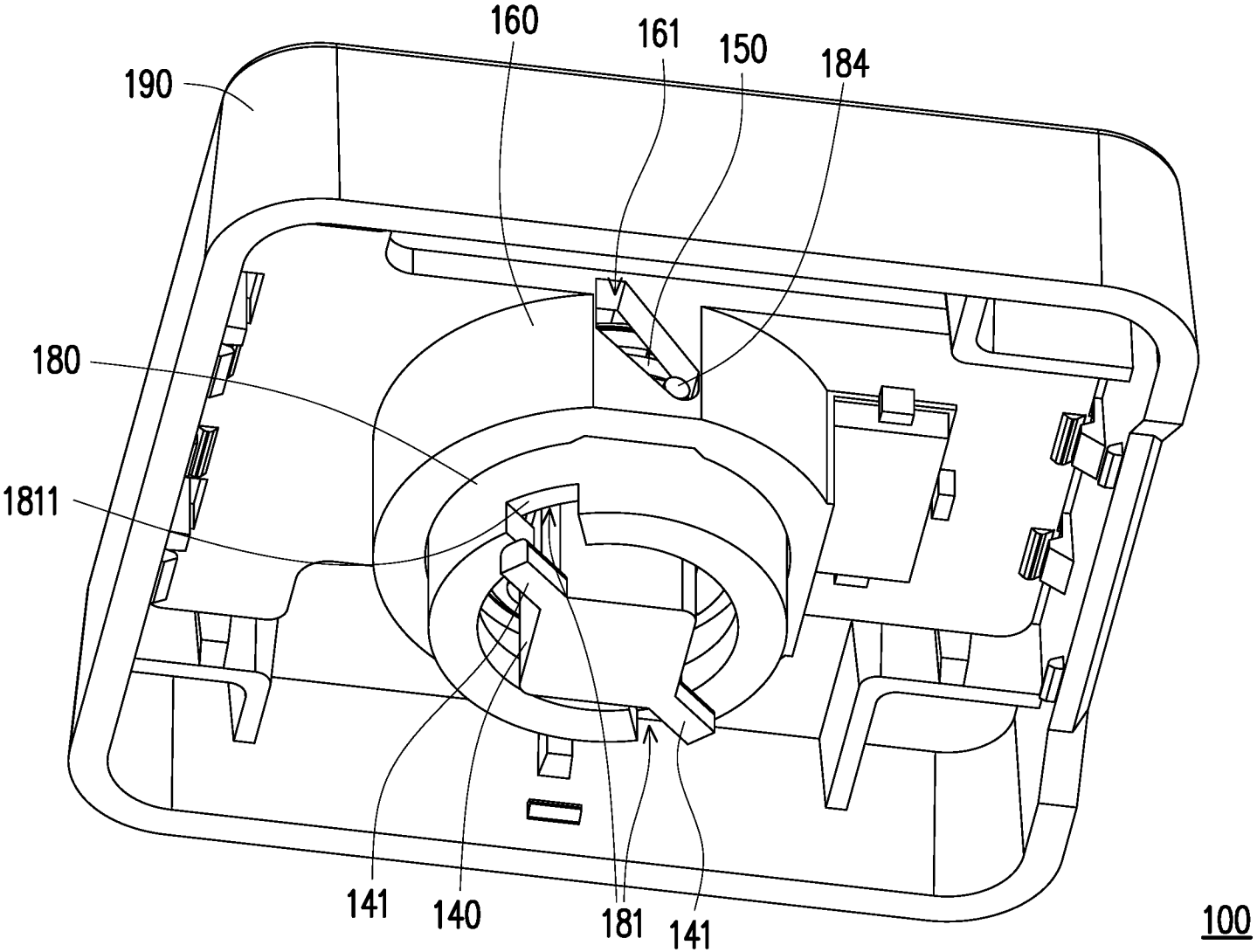
FIGS. 4B and 4C are schematic cross-sectional views illustrating the keycap and the retractable assembly of FIG. 4A when receiving a force and being pressed.
Figure 4C:
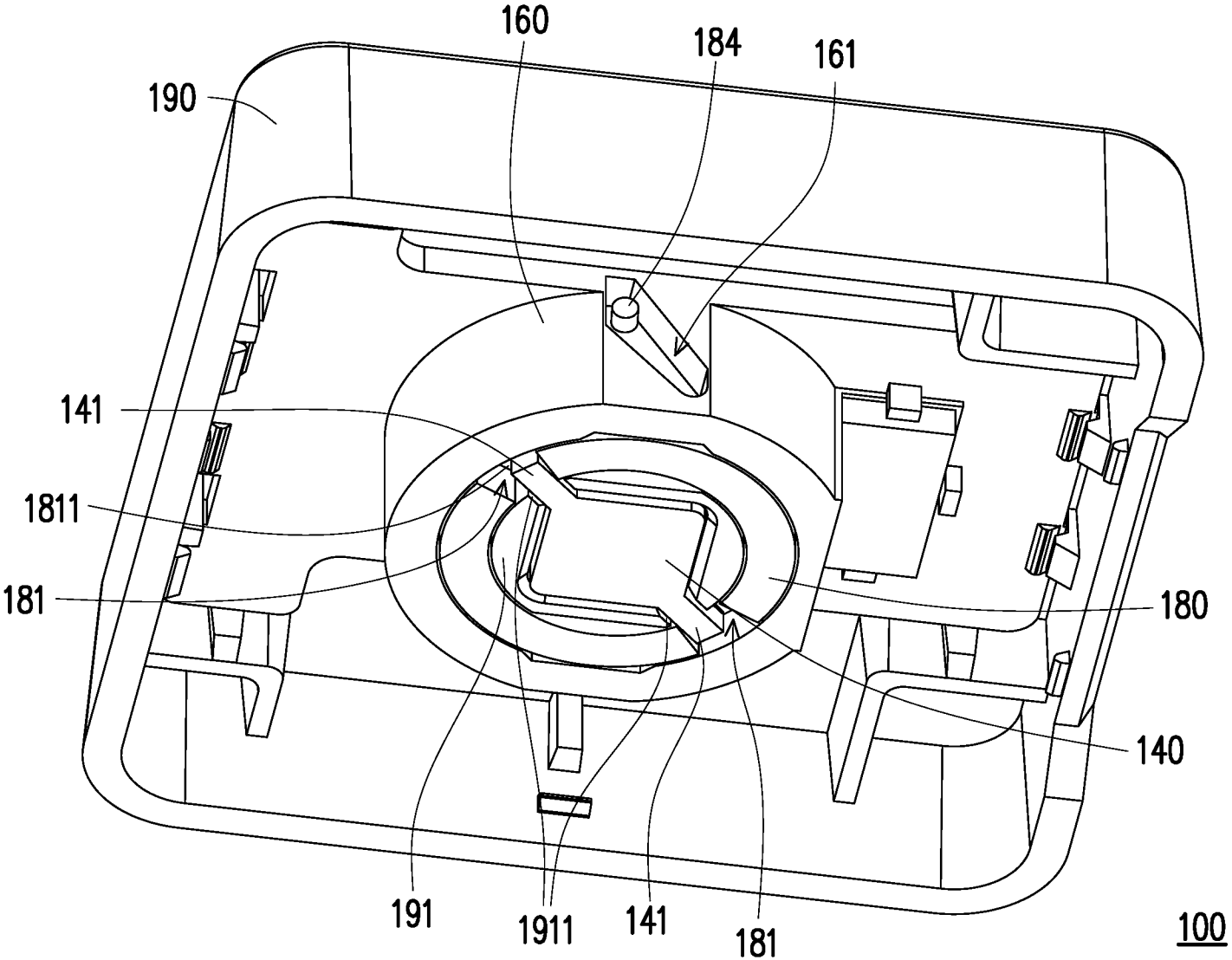

FIG. 4A is a schematic view illustrating a keycap and a retractable assembly of FIG. 1 from another perspective. FIGS. 4B and 4C are schematic cross-sectional views illustrating the keycap and the retractable assembly of FIG. 4A when receiving a force and being pressed. Referring to FIGS. 2A, 2B, 3A, and 4A, the second sleeve 180 further includes a notch 181 opposite to the guiding protrusion 184, the notch 181 faces the base plate 110, and the trigger protrusion 141 is located on the movement path of the notch 181. In the initial state shown in FIGS. 3A and 4A, the trigger protrusion 141 is separated from the second sleeve 180, and the trigger protrusion 141 is located outside the notch 181.

Referring to FIGS. 3B, 3C, 4B, and 4C, when the keycap 190 receives a force and is pressed down to move toward the base plate 110, the first sleeve 160 and the second sleeve 180 synchronously move toward the base plate 110, and the second sleeve 180 abuts against the trigger protrusion 141. At this time, the trigger member 140 makes a first knock with respect to the second sleeve 180 to generate a first operation sound. Then, the keycap 190 and the first sleeve 160 keep moving toward the base plate 110, and the second sleeve 180 slides relatively to the first sleeve 160. Meanwhile, the second sleeve 180 rotates relative to the first sleeve 160 and the trigger member 140, so that the notch 181 moves toward the trigger protrusion 141. When the notch 181 rotates to be aligned to the trigger protrusion 141, the trigger protrusion 141 moves into the notch 181 and contacts a bottom surface 1811 of the notch 181. At this time, the trigger member 140 makes a second knock with respect to the second sleeve 180 to generate a second operation sound.

That is, during the process in which the user presses the key structure 100, the trigger member 140 successively makes two knocks on the second sleeve 180 to generate two operation sounds, thereby facilitating the user's operation experience (e.g., audio sensation). In addition, compared with a key structure adopting a mechanical shaft, the key structure 100 adopts the scissor structure 120. Therefore, the key structure 100 satisfies the design requirement of being thin and compact.

Referring to FIGS. 2A, 2B, and 3A, in the embodiment, the key structure 100 further includes a first spring 150 and a second spring 170. The first spring 150 and the second spring 170 are both compression springs, and the first spring 150 surrounds the second spring 170. The first spring 150 is disposed between the second sleeve 180 and the keycap 190. The first spring 150 has a first end 151 and a second end 152 opposite to the first end 151. In addition, the second end 152 contacts the keycap 190. Moreover, the first end 151 of the first spring 150 is disposed in the second sleeve 180 and abuts against the second sleeve 180.

More specifically, the second sleeve 180 further includes an inner wall surface 182 and a positioning part 183 opposite to the guiding protrusion 184, and the positioning part 183 protrudes from the inner wall surface 182. The positioning part 183 is substantially located at the bottom of the second sleeve 180, and the first end 151 of the first spring 150 abuts against the positioning part 183.

The second spring 170 is disposed between the trigger member 140 and the keycap 190. The trigger member 140 has a groove 143 facing the keycap 190, and the second spring 170 has a first end 171 and a second end 172 opposite to the first end 171. The first end 171 of the second spring 170 is disposed in the groove 143 and abuts against the bottom surface of the groove 143. Besides, the second end 172 of the second spring 170 contacts the keycap 190.

As shown in FIGS. 3A and 3B, when the keycap 190 receives a force and is pressed down to move toward the base plate 110, the first sleeve 160 and the second sleeve 180 synchronously move toward the base plate 110, and the second spring 170 is squeezed by the keycap 190 and the trigger member 140, thereby feeding a first operational feeling and a first reaction force back to the user. Meanwhile, since the second sleeve 180 is originally separated from the trigger protrusion 141 and the base plate 110, the first spring 150 is not squeezed.

As shown in FIGS. 3B, 3C, 4B, and 4C, the keycap 190, the first sleeve 160, and the second sleeve 180 keep moving toward the base plate 110, and the second spring 170 keeps being squeezed by the keycap 190 and the trigger member 140. Besides, the second sleeve 180 firstly abuts against the trigger protrusion 141, and then the second sleeve 180 rotates relative to the first sleeve 160 and the trigger member 140. Moreover, the first sleeve 160 and the second sleeve 180 slide relatively, so that the first spring 150 is squeezed by the keycap 190 and the second sleeve 180. More specifically, the second spring 170 and the first spring 150 squeezed at the same time feed a second operational feeling and a second reaction force back to the user. The second operational feeling is more rigid than the first operational feeling, and the second reaction force is greater than the first reaction force.

In other words, the key structure 100 may feed a step feeling during operation and a two-step operational feeling back to the user.

Referring to FIGS. 2B, 3A, and 4C, the key structure 100 further includes a positioning seat 191 connecting the keycap 190. The positioning seat 191 is located between the base plate 110 and the keycap 190, and is slidably sleeved to the trigger member 140. Specifically, the second end 172 of the second spring 170 is inserted into the positioning seat 191. The positioning seat 191 has a recess 1911 facing the base plate 110, and the trigger protrusion 141 is located on the movement path of the recess 1911. When the trigger protrusion 141 moves into the notch 181 of the second sleeve 181, the trigger protrusion 141 moves into the recess 1911 of the positioning seat 191.

More specifically, the positioning seat 191 moves with the keycap 190 to the base plate 110, and the recess 1911 moves toward the trigger protrusion 141. When the notch 181 of the second sleeve 180 rotates to be aligned to the trigger protrusion 141, the notch 181 of the second sleeve 180 is aligned to the recess 1911 of the positioning seat 191. Accordingly, the trigger protrusion 141 simultaneously moves into the notch 181 and the recess 1911.

Referring to FIGS. 2B and 3A to 3C, the positioning seat 191 further includes a chute 1912, the trigger member 140 has a sliding protrusion 142 opposite to the trigger protrusion 141, and the sliding protrusion 142 is slidably disposed in the chute 1912. With the matching between the sliding protrusion 142 and the chute 1912, the keycap 190 and the positioning seat 191 are able to be stably lifted and lowered vertically. Meanwhile, the extending direction of the chute 1912 is not parallel to the extending direction of the guiding chute 161. The first sleeve 160 is vertically lifted and lowered with the keycap 190, and the extending direction of the chute 1912 is parallel to the movement direction of the first sleeve 160, whereas the movement direction of the first sleeve 160 is not parallel to the extending direction of the guiding chute 161.

Referring to FIGS. 1, 2A, and 3A, in the embodiment, the key structure 100 further includes a frame 130. The frame 130 is removably disposed on the keycap 190, and is located between the keycap 190 and the base plate 110. Specifically, the retractable assembly is formed by the trigger member 140, the first spring 150, the first sleeve 160, the second spring 170, and the second sleeve 180. The frame 130 further includes an opening 131, and the retractable assembly penetrates through the opening 131. Furthermore, the scissor structure 120 has an opening 121 overlapped with the opening 131 of the frame 130, and the retractable assembly penetrates through the opening 121.

In view of the foregoing, in the key structure according to the embodiments of the invention, the retractable assembly is disposed between the keycap and the base plate, and a sound structure is integrated in the retractable assembly. Specifically, the retractable assembly at least includes the first sleeve, the second sleeve, and the trigger member. When the keycap receives a force and moves toward the base plate, the first sleeve and the second sleeve move toward the base plate, and the second sleeve slides and rotates relative to the first sleeve. Besides, the trigger member successively makes two knocks on the second sleeve to generate two operation sounds, thereby facilitating the user's operation experience (e.g., audio sensation). In addition, compared with a key structure adopting a mechanical shaft, the key structure of the invention adopts the scissor structure. Therefore, the key structure of the invention satisfies the design requirement of being thin and compact.

It will be apparent to those skilled in the art that various modifications and variations can be made to the disclosed embodiments without departing from the scope or spirit of the disclosure. In view of the foregoing, it is intended that the disclosure covers modifications and variations provided that they fall within the scope of the following claims and their equivalents.

What is claimed is:

1. A key structure, comprising:

a base plate;

a keycap, disposed above the base plate;

a scissor structure, disposed between the base plate and the keycap;

a first sleeve, connected to the keycap, wherein the first sleeve is located between the base plate and the keycap, and the first sleeve has a guiding chute;

a second sleeve, rotatably inserted into the first sleeve, wherein the first sleeve is slidably sleeved to the second sleeve, the second sleeve has a guiding protrusion and a notch opposite to the guiding protrusion, the guiding protrusion is slidably disposed in the guiding chute, and the notch faces the base plate; and a trigger member, wherein the second sleeve is slidably sleeved to the trigger member, the trigger member has a trigger protrusion contacting the base plate, the trigger protrusion is located between the base plate and the second sleeve, the second sleeve abuts against the trigger protrusion during a process in which the first sleeve and the second sleeve move toward the base plate, the first sleeve keeps moving toward the base plate to drive the second sleeve to rotate relative to the first sleeve, and, when the notch rotates to be aligned to the trigger protrusion, the trigger protrusion moves into the notch and the second sleeve contacts the base plate.

2. The key structure as claimed in claim 1, wherein an extending direction of the guiding chute is not parallel to a movement direction of the first sleeve.

3. The key structure as claimed in claim 1, further comprising:

a first spring, disposed between the second sleeve and the keycap, wherein the first spring has a first end and a second end opposite to the first end, the first end of the first spring is disposed in the second sleeve, and the second end of the first spring contacts the keycap.

4. The key structure as claimed in claim 3, wherein the second sleeve further has an inner wall surface and a positioning part protruding from the inner wall surface, and the first end of the first spring abuts against the positioning part.

5. The key structure as claimed in claim 3, further comprising:

a second spring, disposed between the trigger member and the keycap, and the first spring surrounds the second spring.

6. The key structure as claimed in claim 5, wherein the trigger member has a groove facing the keycap, the second spring has a first end and a second end opposite to the first end, the first end of the second spring is disposed in the groove, and the second end of the second spring contacts the keycap.

7. The key structure as claimed in claim 5, further comprising:

a positioning seat, connected to the keycap, and located between the base plate and the keycap, wherein the positioning seat is slidably sleeved to the trigger member, and the second end of the second spring is inserted into the positioning seat.

8. The key structure as claimed in claim 7, wherein the positioning seat has a recess facing the base plate, the trigger protrusion is located on a movement path of the recess, and when the trigger protrusion moves into the notch, the trigger protrusion moves into the recess.

9. The key structure as claimed in claim 7, wherein the positioning seat comprises a chute, the trigger member has a sliding protrusion relative to the trigger protrusion, and the sliding protrusion is slidably disposed in the chute.

10. The key structure as claimed in claim 9, wherein an extending direction of the chute is not parallel to an extending direction of the guiding chute.

* * * * *